US006231352B1

(12) United States Patent
Gonzales

(10) Patent No.: US 6,231,352 B1
(45) Date of Patent: May 15, 2001

(54) COAXIAL COUPLING FOR INTERCONNECTING TWO PRINTED CIRCUIT CARDS

(75) Inventor: Olivier Gonzales, Saint Nicolas de Macherin (FR)

(73) Assignee: Radiall, Rosny-sous-Bois (FR)

( * ) Notice: Subject to any disclaimer, the term of this patent is extended or adjusted under 35 U.S.C. 154(b) by 0 days.

(21) Appl. No.: 09/497,973

(22) Filed: Feb. 4, 2000

(30) Foreign Application Priority Data

Feb. 11, 1999 (FR) ..... 99 01635

(51) Int. Cl.[7] ..... H01R 12/00
(52) U.S. Cl. ..... 439/66
(58) Field of Search ..... 439/66, 74, 63, 439/83, 578, 290

(56) References Cited

U.S. PATENT DOCUMENTS 4,511,196 4/1985 Schuler et al. ..... 439/66
5,345,366 * 9/1994 Cheng et al. ..... 439/74
5,380,211 * 1/1995 Kawaguxhi et al. ..... 439/74
5,718,592 * 2/1998 Hosler, Sr. et al. ..... 439/63
5,857,867 * 1/1999 Henry ..... 439/290
5,928,000 * 7/1999 Rdisill et al. ..... 439/63
5,975,914 * 11/1999 Uchida ..... 439/74

FOREIGN PATENT DOCUMENTS 0582145 2/1994 (EP) .

OTHER PUBLICATIONS

Patent Abstract of Japan, vol. 016, No. 240 (E–1121), Jun. 3, 1992.

* cited by examiner

*Primary Examiner*—Tulsidas Patel
(74) *Attorney, Agent, or Firm*—Schweitzer Cornman Gross & Bondell LLP

(57) ABSTRACT

A coaxial coupling for interconnecting two printed circuit cards, comprising an outer cylindrical conductor with assembly tabs extending from both ends into contact with the cards; an inner conductor coaxially disposed within the outer conductor with any tabs extending form both ends into contact with the cards; and tubular insulator extending through the outer conductor and holding the inner conductor in the outer conductor.

15 Claims, 4 Drawing Sheets

COAXIAL COUPLING FOR INTERCONNECTING TWO PRINTED CIRCUIT CARDS

The present invention relates to a coaxial coupling for interconnecting two printed circuit cards.

BACKGROUND OF THE INVENTION

In order to establish a coaxial link between two printed circuit cards that are parallel and adjacent, coaxial connectors are known which are devices of the type constituted by two elements to be connected together, each of which elements is soldered to a respective printed circuit card and is capable of coupling with the other element when the two printed circuit cards are moved close to each other.

Such coaxial connectors give satisfaction so far as their electrical properties are concerned.

However, they raise certain difficulties when there is a need to place a plurality of them between two printed circuit cards, since the way in which their connector elements couple together requires each of them to be positioned very accurately on the corresponding card.

Each connector element must be exactly in line with the connector element with which it is to couple, and that is possible only if the relative positions between the connector elements on one card are accurately identical to the relative positions between the corresponding connector elements on the other card.

In addition, the coupling interface must have exactly the same axial travel from one connector to another, and that is not easy to obtain even if all of the connectors are identical since two connector elements on a given card are not necessarily accurately in the same plane, in particular because they are soldered to the card.

In addition, known coaxial connectors are of relatively large height in the connected state, which determines a lower limit on how close the two printed circuit cards connected in this way can be brought together.

Finally, each of the connector elements of a coaxial connector presents a degree of structural complexity which makes such connectors relatively difficult and expensive to manufacture.

OBJECTS AND SUMMARY OF THE INVENTION

The present invention seeks to provide a coaxial coupling between two printed circuit cards which does not present the drawbacks outlined above and which also provides other advantages that appear in the description below.

The present invention provides a coaxial coupling for interconnecting two printed circuit cards, the coupling comprising:

- a cylindrical outer conductor provided at a first one of its bases with at least one assembly tab for coming into electrical contact with a conductive track of a first printed circuit card, and at its second base with at least one contact tab designed to come into electrical contact with a conductive track of a second printed circuit card;
- tubular insulation received in said outer conductor and in which there is provided a through passage extending from one base to the other of said outer conductor; and
- an inner conductor received in the through passage of the tubular insulation and having an assembly tab projecting from the tubular insulation at its end corresponding to the first base of the outer conductor, said tab being designed to come into electrical contact with a conductive track of the first printed circuit card, and having a contact tab projecting from the tubular insulation at its end corresponding to the second base of the outer conductor, said contact tab being designed to come into electrical contact with a conductive track of the second printed circuit card.

The assembly tabs and/or contact tabs may be secured to the tracks of the cards or they may be put into pressure thereagainst.

In a particular embodiment of the invention, the contact tabs are shaped as elastically deformable tongues extending from the conductor in respective directions that slope relative to the planes of the two printed circuit cards and terminated by respective bearing zones substantially parallel to the planes of the printed circuit cards, with said contact tabs coming to bear against the second printed circuit card via said bearing zones.

In this embodiment, electrical contact between the contact tabs and the conductive tracks of the second printed circuit card is established by putting the contact tabs under pressure against the tracks of the second card at the moment when said second card is brought close to the first card.

This embodiment presents the advantage of accommodating differences in positioning between the two printed circuit cards, particularly when both printed circuit cards are interconnected via a plurality of coaxial couplings of the invention.

Furthermore, in this embodiment, each bearing zone comes into contact with a conductive track of the second printed circuit card by sliding a little against said track due to the deformation of the tongue, thereby giving rise to automatic cleaning of the contact surfaces and guaranteeing good electrical connection between the contact tabs and the conductive tracks.

In this embodiment, the two printed circuit cards can be separated from each other without subjecting the coupling to any traction, thereby saving the assembly tabs from any mechanical extraction forces.

In accordance with the invention, the assembly tabs can be secured to the first printed circuit card by being soldered to the surface of the printed circuit card or by being soldered in plated-through holes therein.

They can also be secured by using press-fit type pins which are inserted as a force-fit in plated-through holes.

In a preferred embodiment of the invention, the outer conductor is made as a single piece by being cut out from a metal sheet and being rolled up.

In another embodiment of the invention, compatible with the preceding embodiment, the inner conductor is formed by a metal strip that is curved at each of its ends, said curved portions constituting the contact tab and the assembly tab of the inner conductor.

In which case, the passage through the tubular insulation can advantageously be offset from the axis of the outer conductor so as to lengthen the contact tabs and the assembly tabs of the inner conductor without increasing the overall size of the coupling on the card.

In a particular variant of this embodiment, the strip constituting the inner conductor has a middle portion between its contact tab and its assembly tab which is rolled up so as to constitute an inner conductor that is tubular that is more rigid.

In another embodiment of the invention, the contact tabs and/or the assembly tabs are curved towards the inside of the cylinder constituting the outer conductor so as to reduce the footprint of the coupling on the card.

In a first particular embodiment of the invention, the tubular insulation is made merely by molding, and it is assembled with both the inner conductor and the outer conductor.

To this end, the insulation may include a lateral slot connecting its through passage to one of its generator lines and enabling the inner conductor to be inserted therein by radial translation. Such a slot is particularly useful when the contact and assembly tabs of the inner conductor have already been curved and no longer lie on the axis of its middle portion.

When the assembly and contact tabs are in line with the middle portion of the inner conductor, the inner conductor can be inserted into the through passage of the insulation by axial translation.

In a second particular embodiment of the invention, the tubular insulation is made by being overmolded around the inner conductor.

In both of the preceding embodiments, the tubular insulation, with or without the inner conductor, is inserted into the outer conductor where it is held by snap-fastening.

In a third particular embodiment of the invention, the tubular insulation is made by being overmolded on the inner conductor and on the outer conductor which are suitably positioned relative to each other in the mold, thereby enabling the coupling of the invention to be obtained in a single molding operation without any mounting or assembly operation between the various component parts of the coupling being necessary.

In this embodiment, the overmolding of the inner and outer conductors may be accompanied by the formation of an insulating covering overlying the outside wall of the outer conductor.

In a particular embodiment of the invention, the tubular insulation presents a plane surface at its end adjacent to the second base of the outer conductor, which surface is suitable for being engaged by the suction nozzles of a pick and place type device of the kind commonly used in the field of the invention.

The coaxial coupling of the invention presents a structure which enables it to be given very small dimensions and which enables it to be used in miniature applications such as telephony. By way of example, the coupling of the invention can have an overall height of about 3 mm.

Its great structural simplicity also makes it possible to manufacture the coupling by using means that are simple and of low cost, while also conferring a high degree of reliability thereto.

BRIEF DESCRIPTION OF THE DRAWINGS

In order to make the invention better understood, there follows a description of embodiments given as examples that do not limit the scope of the invention, and with reference to the accompanying drawings, in which.

MORE DETAILED DESCRIPTION

Figure 1:
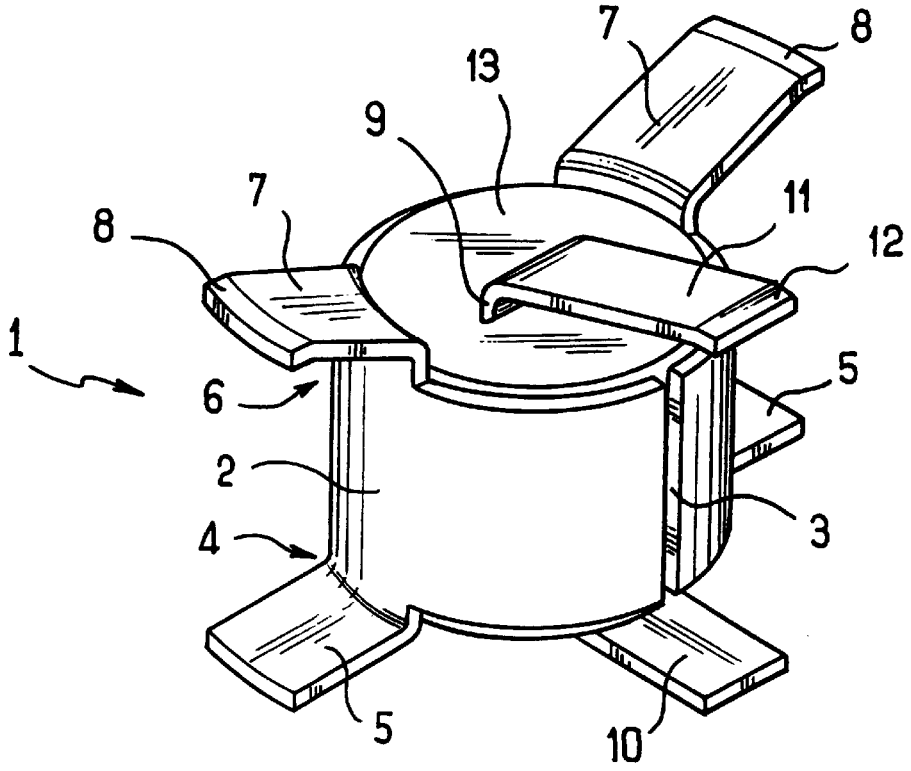
FIG. 1 is a perspective view of a coupling constituting a first embodiment of the invention.
Figure 2:
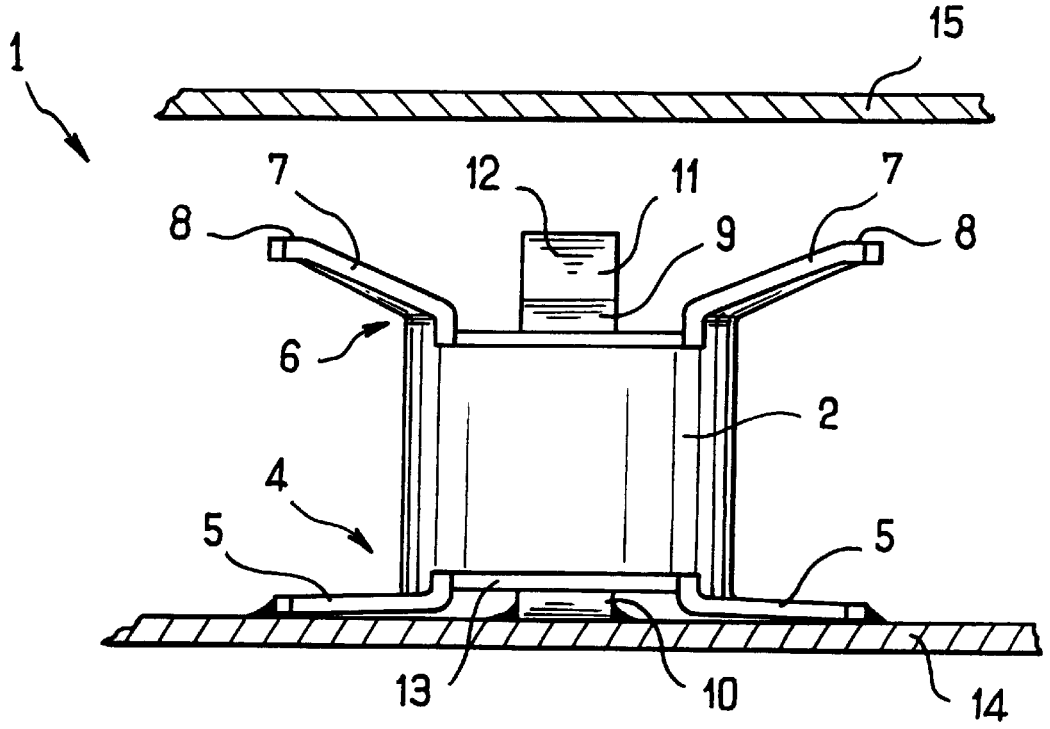
FIG. 2 is a side elevation view of the FIG. 1 coupling used for electrically interconnecting two printed circuit cards.

In the embodiment of FIGS. 1 and 2, the coaxial coupling 1 comprises an outer conductor 2 formed by cutting out a metal strip and rolling it into a cylinder that is split along one of its generator lines 3. At the bottom base 4 of the cylinder ("bottom" relative to the drawing), two assembly tabs 5 extend outwards, perpendicularly to the axis of said cylinder.

At the top base 6 of the cylinder, two contact tabs 7 extend obliquely relative to the axis of the cylinder, and likewise outwards relative thereto.

Each contact tab 7 is terminated by a plane bearing zone 8 forming a portion of a ring that is coaxial with the cylinder, and that is substantially perpendicular to the axis of the cylinder. It will be observed that each assembly tab 5 is in register along the axis of the cylinder with a respective one of the contact tabs 7.

The coupling 1 also has an inner conductor 9 in the form of a strip line which is curved at each of its ends so as to form both an assembly tab 10 extending perpendicularly to the axis of the cylinder and a sloping contact tab 11 which is terminated by a bearing zone 12 similar to the bearing zones of the contact tabs of the outer conductor.

The middle portion of the inner conductor 10 is embedded in tubular insulation 13 made around said middle portion by overmolding and then inserted together with the inner conductor 9 inside the outer conductor 2.

The insulation can be inserted into the outer conductor in two different ways.

Firstly, it is possible to splay apart the facing edges of the lateral slot 3 in the outer conductor by deforming the conductor elastically so as to insert the insulation and the inner conductor axially, with the assembly tab 10 and the contact tab 11 of the inner conductor being in line with the slot 3 as enlarged in this way.

Secondly, it is possible to insert the insulation axially into the outer conductor prior to curving at least one of the contact and assembly tabs of the inner conductor, and then curving said tab once the insulation has been put into place in the outer conductor.

The insulation is held axially in the outer conductor by snap-fastening, with the help of appropriate cutouts (not shown in FIGS. 1 and 2) formed in the wall of the outer conductor, as described below with reference to FIGS. 3 to 5.

As can be seen in FIG. 2, the assembly tabs 5 and 10 are soldered to conductor tracks of a first printed circuit card 14 while the contact tabs 7, 11 are placed facing a second printed circuit card 15 that extends parallel to the first.

Because the assembly tabs 5 of the outer conductor 2 are offset from the axis of the cylinder in directions going away from the assembly tab 10 of the inner conductor, they co-operate with said assembly tab of the inner conductor to form a support triangle whose center lies substantially in register parallel to the axis of the cylinder with the center of gravity of the coupling.

In other words, this configuration of the assembly tabs guarantees that each of them rests suitably against the first printed circuit card.

Having the contact tabs 7, 11 in the same configuration likewise ensures that each of them can press against the second printed circuit card.

The contact tabs 7, 11 are put into electrical contact with conductive tracks on the second printed circuit card 15 by moving the two cards towards each other and pressing down on the contact tabs 7, 11.

Figure 3:
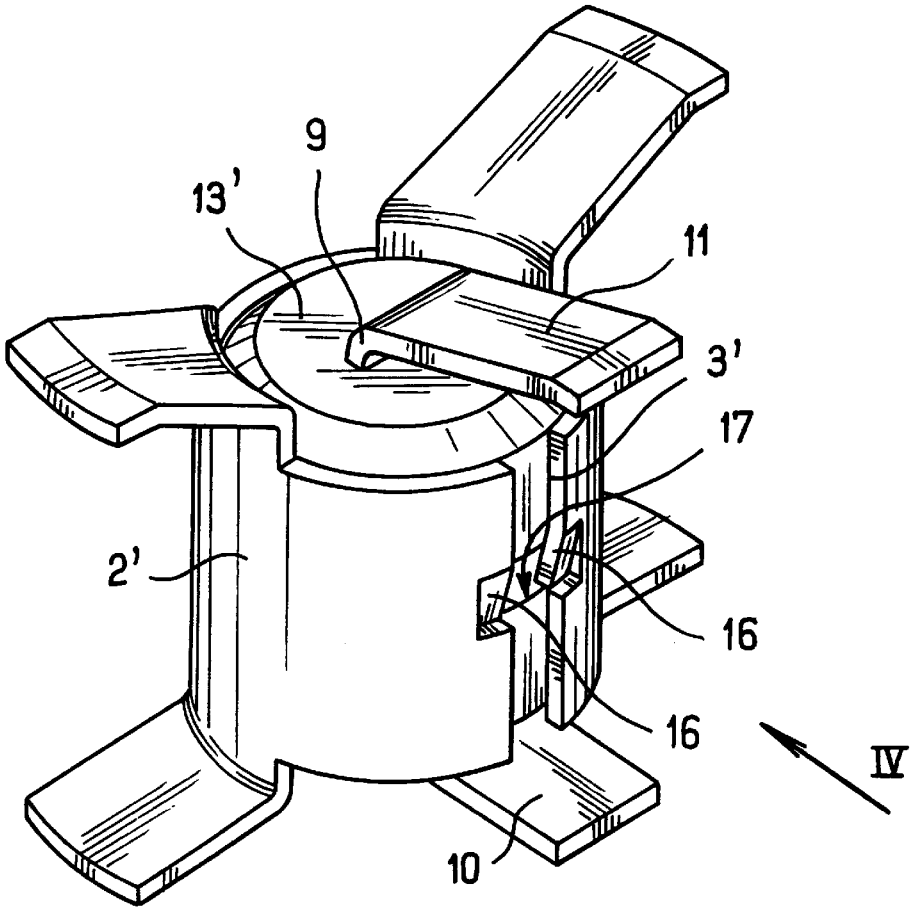
FIG. 3 is a view analogous to FIG. 1 showing a coupling constituting another embodiment of the invention.
Figure 4:
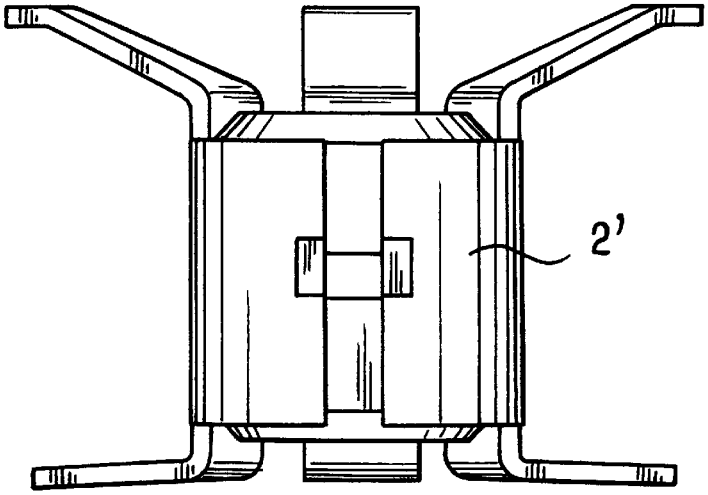
FIG. 4 is a lateral elevation view of the FIG. 3 coupling as seen along arrow IV.
Figure 5:
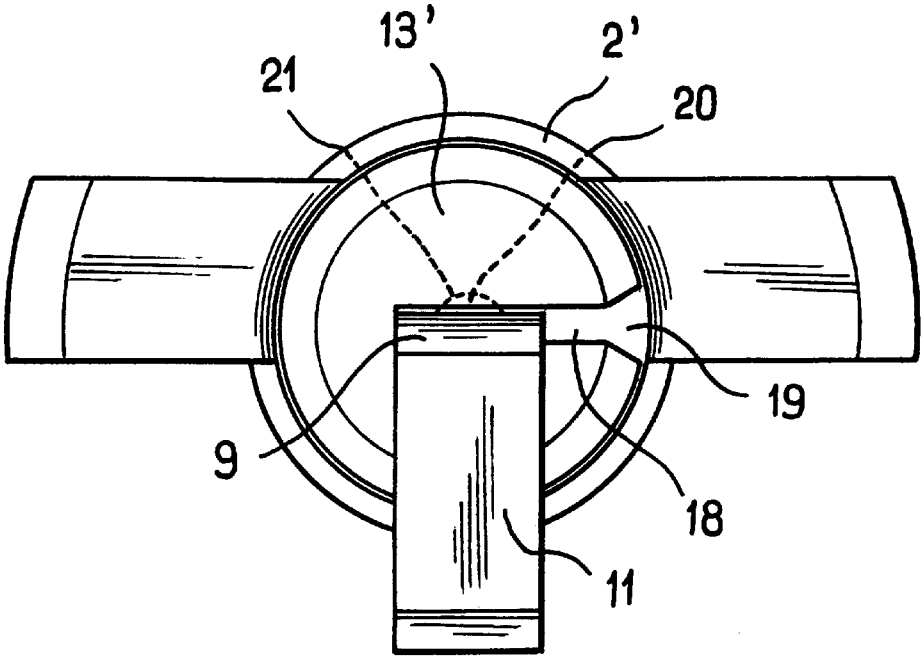
FIG. 5 is a plan view of FIG. 4.

In the embodiment of FIGS. 3, 4, and 5, where elements identical to those described above are given the same reference numerals, the outer conductor 2' is substantially identical to the above-described outer conductor except that its lateral slot 3' is wider, thereby reducing the extent to which it needs to be deformed to allow the tubular insulation 13' surrounding the inner conductor to be inserted axially therein.

In addition, on each edge of its slot, the outer conductor 2' has barbs 16 cut out in the thickness of its wall and directed towards the inside of the cylinder so as to engage a shoulder 17 in the tubular insulation formed for this purpose to be in register with the barbs.

In this case, the tubular insulation 13' is made merely by molding, and it has a lateral slot 18 which extends from one of its generator lines to beyond its axis.

The slot 18 opens to the outside via a chamfer 19 which enables the inner conductor 9 to be engaged as a force-fit while its ends are curved to form the assembly tab 10 and the contact tab 11.

The inner conductor 9 has one or more bulges 20 in its middle portion projecting from its face that faces away from its assembly and contact tabs.

The width of the slot in the tubular insulation is greater than the thickness of the strip constituting the inner conductor, but smaller than the overall thickness of the inner conductor when the bulges are included. The bulges 20 serve to hold the inner conductor in the insulation.

The coupling shown in FIGS. 3, 4, and 5 operates identically to the coupling shown in FIG. 2.

Figure 6:
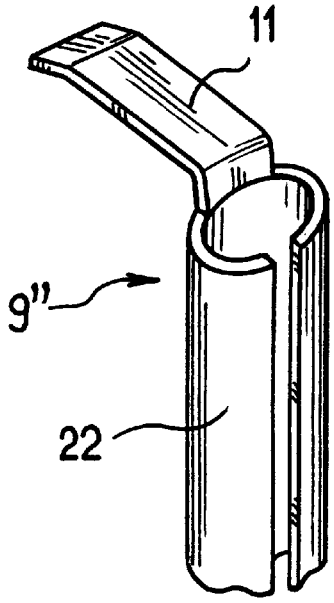
FIG. 6 is a perspective view showing a portion of an inner conductor in another embodiment of the invention.

FIG. 6 shows an inner conductor 9' in another embodiment of the invention.

This inner conductor comprises a middle portion 22 that is rolled, causing it to be cylindrical in shape.

This cylindrical shape presents several advantages.

Firstly, it is more suitable for making a coaxial line.

Secondly, it stiffens the middle portion of the inner conductor, thereby preventing the middle portion from bending under the effect of the pressure applied thereto by the second printed circuit card. As a result, the only forces which the inner conductor can transmit to its assembly tab are forces normal to the planes of the printed circuit cards, thereby protecting the solder of said assembly tab from transverse stresses which could shorten its lifetime.

In the above embodiments, the middle portion of the inner conductor is held parallel to the axis of the cylinder by the insulation.

Figure 7:
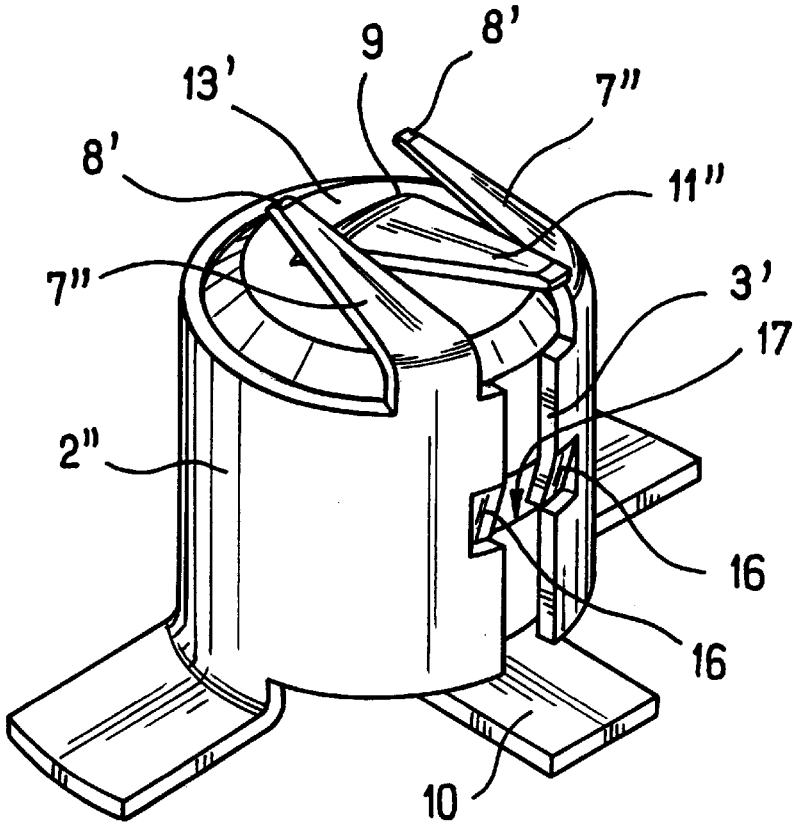
FIG. 7 is a perspective view of a coupling constituting another embodiment of the invention.
Figure 8:
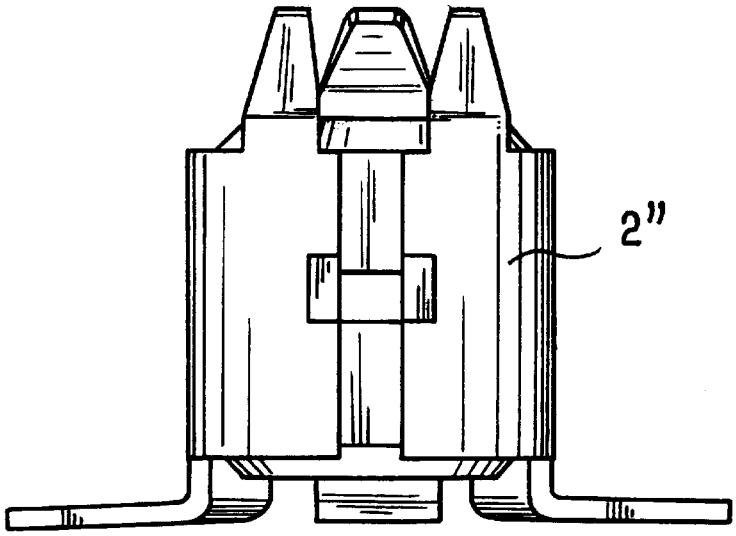
FIG. 8 is an elevation view of the FIG. 7 coupling.

In the embodiment shown in FIGS. 7 and 8, the coupling 2" has contact tabs 7" and 11" that are curved inwards, thereby reducing the overall size of the coupling, which is otherwise identical to the coupling of FIGS. 3 to 5.

In a variant (not shown) the coupling can have assembly tabs that are shaped like the contact tabs 7" and 11" of FIGS. 7 and 8. In which case, the coupling is held between the two cards by mechanical means other than the tabs, given that all of its tabs are connected to the tracks of the cards solely by being pressed thereagainst.

Naturally, the embodiments described above are not limiting in any way and could be modified in any desirable manner without thereby going beyond the ambit of the invention.

What is claimed is:

1. A coaxial coupling for interconnecting two printed circuit cards, the coupling comprising:

a cylindrical outer conductor made as a single piece and provided at a first one of its bases with at least one assembly tab for coming into electrical contact with a conductive track of a first printed circuit card, and at its second base with at least one contact tab designed to come into electrical contact under pressure with a conductive track of a second printed circuit card when said second printed circuit card is brought close to said first printed circuit card;

tubular insulation received in said outer conductor and in which there is provided a through passage extending form one base to the other of said outer conductor; and an inner conductor received in the through passage of the tubular insulation and having an assembly tab projecting from the tubular insulation at its end corresponding to the first base of the outer conductor, said tab being designed to come into electrical contact with a conductive track of the first printed circuit card, and having a contact tab projecting from the tubular insulation at its end corresponding to the second base of the outer conductor, said contact tab being designed to come into electrical contact with a conductive track of the second printed circuit card.

2. A coupling according to claim 1, wherein its assembly tabs and/or its contact tabs are adapted to be secured to the tracks of the cards or are adapted to be put into pressure thereagainst.

3. A coupling according to claim 1, wherein the contact tabs are shaped as elastically deformable tongues extending from the conductor in respective directions that slope relative to the planes of the two printed circuit cards and terminated by respective bearing zones substantially parallel to the planes of the printed circuit cards, with said contact tabs being adapted to bear against the second printed circuit card via said bearing zones.

4. A coupling according to claim 1, wherein the assembly tabs are adapted to be secured to the first printed circuit card by being soldered to the printed circuit card.

5. A coupling according to claim 1, wherein the outer conductor is made by being cut out from a metal sheet and being rolled up.

6. A coupling according to claim 1, wherein the inner conductor is formed by a metal strip that is curved at each of its ends, said curved portions constituting the contact tab and the assembly tab of the inner conductor.

7. A coupling according to claim 6, wherein the passage through the tubular insulation lies off the axis of the outer conductor so as to match the impedance of the coaxial line.

8. A coupling according to claim 6, wherein the strip constituting the inner conductor has a middle portion between its contact tab and its assembly tab which is rolled up to constitute a tubular inner conductor.

9. A coupling according to claim 1, wherein the tubular insulation is made by molding, and is assembled with both the inner conductor and the outer conductor.

10. A coupling according to claim 9, wherein the insulation includes a lateral slot enabling the inner conductor to be inserted therein by radial translation.

11. A coupling according to claim 1, wherein the tubular insulation is made by being overmolded around the inner conductor.

12. A coupling according to claim 9, wherein the tubular insulation, with or without the inner conductor, is inserted into the outer conductor where it is held by a snap-fastening connection.

13. A coupling according to claim 1, wherein the tubular insulation is made by being overmolded on the inner conductor and on the outer conductor which are coaxially positioned relative to each other in the mold.

14. A coupling according to claim 13, wherein the overmolding of the inner and outer conductors is accompanied by the formation of an insulating covering overlying the outside wall of the outer conductor.

15. A coupling according to claim 1, wherein the tubular insulation presents a plane surface at its end adjacent to the second base of the outer conductor, said surface being of sufficient size to be readily engaged by suction material handling apparatus.

* * * * *